US007748074B2

(12) United States Patent
Guizzi

(10) Patent No.: US 7,748,074 B2
(45) Date of Patent: Jul. 6, 2010

(54) SQUEEGEE FOR SURFACE CLEANING

(75) Inventor: Giulio Guizzi, Mompiano (IT)

(73) Assignee: Pulex S.r.l., Mompiano, Brescia (IT)

( * ) Notice: Subject to any disclaimer, the term of this patent is extended or adjusted under 35 U.S.C. 154(b) by 1152 days.

(21) Appl. No.: 10/571,104

(22) PCT Filed: Sep. 9, 2003

(86) PCT No.: PCT/IT03/00541

§ 371 (c)(1),
(2), (4) Date: Mar. 8, 2006

(87) PCT Pub. No.: WO2005/023075

PCT Pub. Date: Mar. 17, 2005

(65) Prior Publication Data

US 2006/0260084 A1 Nov. 23, 2006

(51) Int. Cl.
*A47L 1/06* (2006.01)

(52) U.S. Cl. ..... 15/245; 15/152

(58) Field of Classification Search ..... 15/245, 15/144.1, 144.2, 146, 150, 210.1
See application file for complete search history.

(56) References Cited

U.S. PATENT DOCUMENTS 559,023 A 4/1896 Barron
1,628,783 A * 5/1927 Jensen et al. ..... 15/245
2,225,432 A * 12/1940 Ginsberg ..... 15/245
2,328,287 A 8/1943 Martin
2,440,099 A * 4/1948 Kind ..... 15/245
3,892,005 A 7/1975 Berns
4,336,624 A 6/1982 Pichelman et al.
4,697,296 A * 10/1987 Smahlik ..... 15/245
4,777,694 A * 10/1988 Young ..... 15/245
5,930,863 A 8/1999 Samuelson
2004/0226125 A1 * 11/2004 Cox ..... 15/245

* cited by examiner

*Primary Examiner*—Dung Van Nguyen
(74) *Attorney, Agent, or Firm*—Shoemaker and Mattare

(57) ABSTRACT

A window squeegee (1) for cleaning surfaces, such as sky-scraper windows, comprises a handle (2) associated to a head (11) provided with a first connection element (12) and a second connection element (18) for connecting a spatula (46) to the handle (2). In a condition of normal use of the window squeegee, the spatula (46) is held between the first element (12) and the second element (18) and in a condition of replacement of the spatula, the second element (18) is rotated by the first element (12) to allow the replacement of the spatula (46) which is held associated to the head (11) of the window squeegee and is not free to remove, to ensure a safe replacement.

15 Claims, 2 Drawing Sheets

SQUEEGEE FOR SURFACE CLEANING

BACKGROUND OF THE INVENTION

1. Field of the Invention

The present invention relates to a window squeegee for cleaning surfaces, such as the glass surfaces of skyscrapers, the glasses of a window, typically during a surface cleaning operation, which is usually carried out in balance at considerable height.

2. Description of the Prior Art

Generally, window squeegees are provided with a spatula provided with a cleaning blade that comes into contact with the surface and, pulled over it, allows the removal of the liquid—usually water and detergent—used for cleaning.

Residues of dirt, such as dust, mud or the like, following the use of the window squeegee tend to accumulate on the cleaning blade, and during a subsequent cleaning operation, for example, a part of them could come off the blade and be spread onto the surface to be cleaned, soiling it further.

It is therefore necessary to replace the spatula or the cleaning blade according to the needs.

In special use conditions, such as when cleaning skyscraper windows or windows at a certain height, the cleaning operation is often carried out in unstable balance conditions for the user of the window squeegee, so there is the need of replacing the spatula in a quick and safe manner.

It is therefore necessary to replace the spatula in a safe and quick manner, ensuring at the same time that during normal use, the removable and replaceable spatula is suitably held so as to allow an easy cleaning of the surface.

SUMMARY OF THE INVENTION

The problem at the basis of the present invention is that of devising a window squeegee which should exhibit such structural and functional features as to meet the above requirements while at the same time obviating the disadvantages mentioned with reference to known solutions.

Such problem is solved by a window squeegee according to the following claims. The dependent claims describe further variants of embodiments.

BRIEF DESCRIPTION OF THE DRAWINGS

Further features and advantages of the window squeegee according to the present invention will appear more clearly from the following description of a preferred and non-limiting example of embodiment, wherein.

DESCRIPTION OF THE PREFERRED EMBODIMENT

Figure 2:
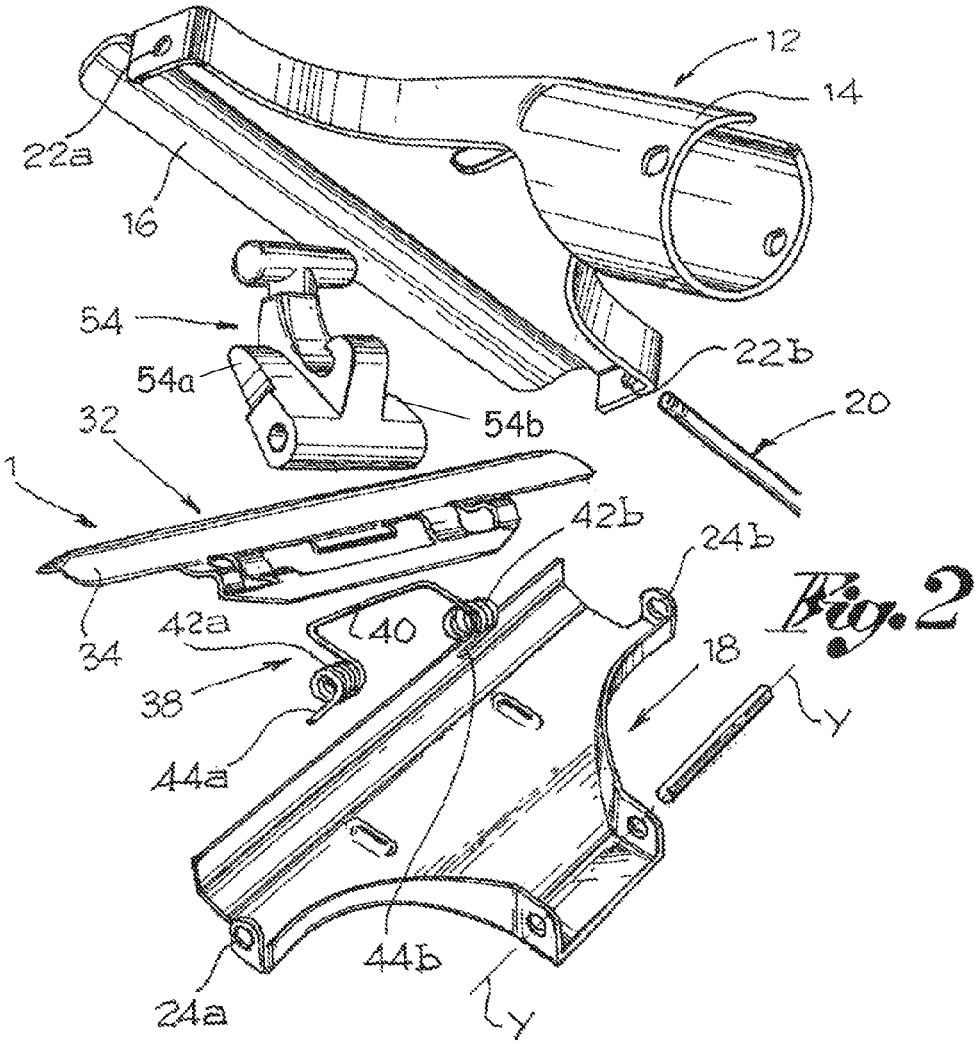
FIG. 2 shows the window squeegee of FIG. 1 according to a three-dimensional view with separate parts.
Figure 1:
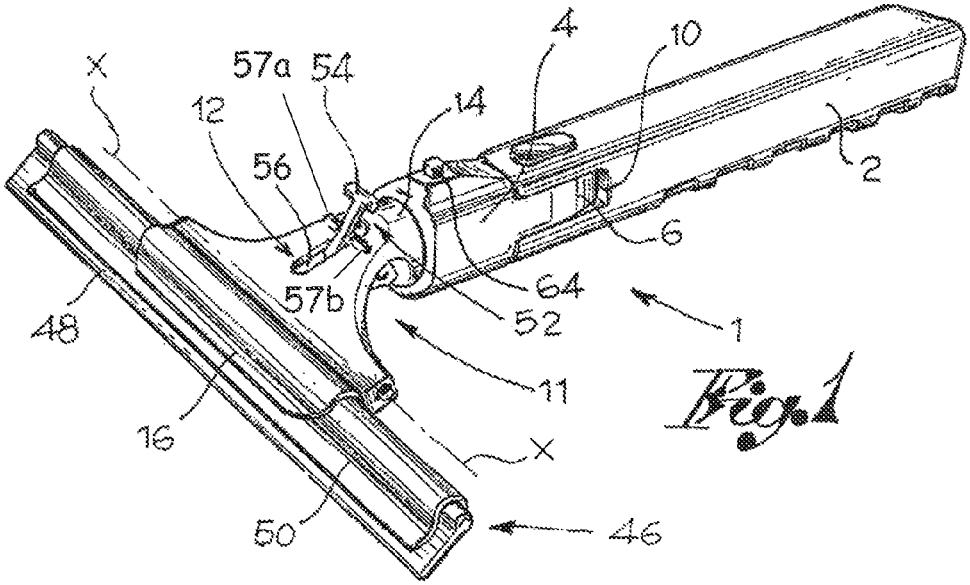
FIG. 1 shows a three-dimensional view of a window squeegee according to the present invention.

With reference to the attached figures, reference numeral 1 globally indicates a window squeegee according to the invention.

Said window squeegee is suitable for cleaning surfaces such as skyscraper windows, window glasses, shop windows and even windscreens or back windows of motor vehicles, removing liquid from said surface, generally water mixed with detergent, typically during an operation for cleaning said surfaces.

Squeegee 1 comprises a handle 2, generally having an elongated shape according to a longitudinal direction, adapted for being gripped by a user to carry out the surface cleaning operation in plane or height.

Said handle is a preferred example of embodiment of gripping means, adapted for allowing the desired use of the tool.

In a preferred articulated embodiment, handle 2 is connected to a bushing 4 provided with a projection 6 for the connection to said handle 2 and at a side opposed said projection, with a seat 8.

Projection 6 is suitable for being housed into a corresponding recess 10 of the handle, to which said bushing 4 is associated.

Squeegee 1 is provided with a head 11, comprising a first connection element 12.

In an embodiment, said head is connected to the gripping means, for example to handle 2.

In a further embodiment, said head is connected to bushing 4.

Preferably, said first connection element 12 is provided with a projection 14 suitable for being housed into seat 8 of bushing 4 or of handle 2, preferably held by locking means comprising, for example, a thorough seat—pin system.

In a preferred embodiment, the first connection member 12 extends enlarging from said projection 14 in a transversal direction substantially perpendicular to said longitudinal direction of handle 2.

At the end opposed said projection 14, the connection element 12 is provided with a flange 16, preferably having an undulated shape according to said longitudinal direction.

Head 11 also comprises a second connection element 18, hinged relative to an axis of rotation X-X to said first connection element 12 and adapted for rotating and opening relative to it.

For example, said second element 18 is hinged to said first element 12 by a pin 20 that engages a pair of holes 22*a*, 22*b* of said first element 12 and a pair of holes 24*a*, 24*b* of said second element 18, said holes being coaxial to said rotation axis X-X.

Said rotation axis X-X determines in said second element 18 a first portion 26 and a second portion 28 provided with a flap 30 at an end.

Moreover, said head 11 comprises a third connection element 32.

In a preferred embodiment, the third connection element 32 is hinged along said rotation axis X-X.

For example, said third connection element 32 is hinged to said first connection element 12 and to said second connection element 18 by said pin 20.

The rotation axis X-X determines on said third element 32 a first thrust portion 34, close to the end of the first element 12 provided with flange 16, and a second portion 36.

Squeegee 1 also comprises elastic means 38, provided between said second element 18 and said third element 32, suitable for constantly affecting said third element and said second element.

For example, said elastic means 38 comprises a spring provided with a rectilinear portion 40, acting on the thrust portion 34 of the third element 32, spiral portions 42*a*, 42*b* ending in side portions 44*a*, 44*b* acting on said second element 18.

Said squeegee 1 also comprises a spatula 46 provided with a cleaning blade 48, typically made of rubber, synthetic rubber or plastic and preferably inserted in a spatula holder 50, generally made of a metal material.

In a variant of embodiment, squeegee 1 is provided with locking/release means 52, preferably manually actuable, suitable for locking and/or releasing spatula 46.

In a variant of embodiment, said locking/release means 52 comprise a lever 54 hinged to the second connection element 18 at a release axis Y-Y parallel and distinct from said rotation axis X-X of the second connection element 18.

In an embodiment, lever 54 is provided with abutment shoulders 54*a*, 54*b*.

In a variant of embodiment, said squeegee 1 is provided with said release lever 54 protruding from said first connection element 12 through an opening 56.

Preferably, said squeegee 1 is provided with means for locking lever 54, preferably comprising recesses arranged inside said first connection element 12, for example at the sides of said opening 56. Outside said first element 12, said recesses determine respective projections 57*a*, 57*b*.

Preferably, said squeegee 1 also comprises safety means 58 adapted for preventing the operation of said locking/release means 52.

According to an embodiment, said safety means 58 comprises a locking element 60 hinged at a safety axis Z-Z, for example passing through bushing 4 and parallel to said release axis Y-Y.

Said locking element 60 is constantly affected by an elastic element 62. Moreover, a button 64 protruding for example from said bushing 4, abuts on said locking element, adapted for being pressed by a user so that the user's action opposes the action of said elastic element 62 on said locking element 60.

In a variant of embodiment, said lever 54 of the locking/release means 52 and said button 64 of the safety means 58 are arranged so as to be actuated, the lever subsequently the button.

According to a variant of embodiment, squeegee 1 is provided with a snap mechanism comprising a first hook element 66*a* protruding from lever 54 and a second hook element 66*b*, protruding from said locking element 60.

Preferably, said first and said second hook element 66*a*, 66*b* are provided with facing surfaces provided with a contour suitable for allowing the relative sliding following the rotation of lever 54.

Figure 3:
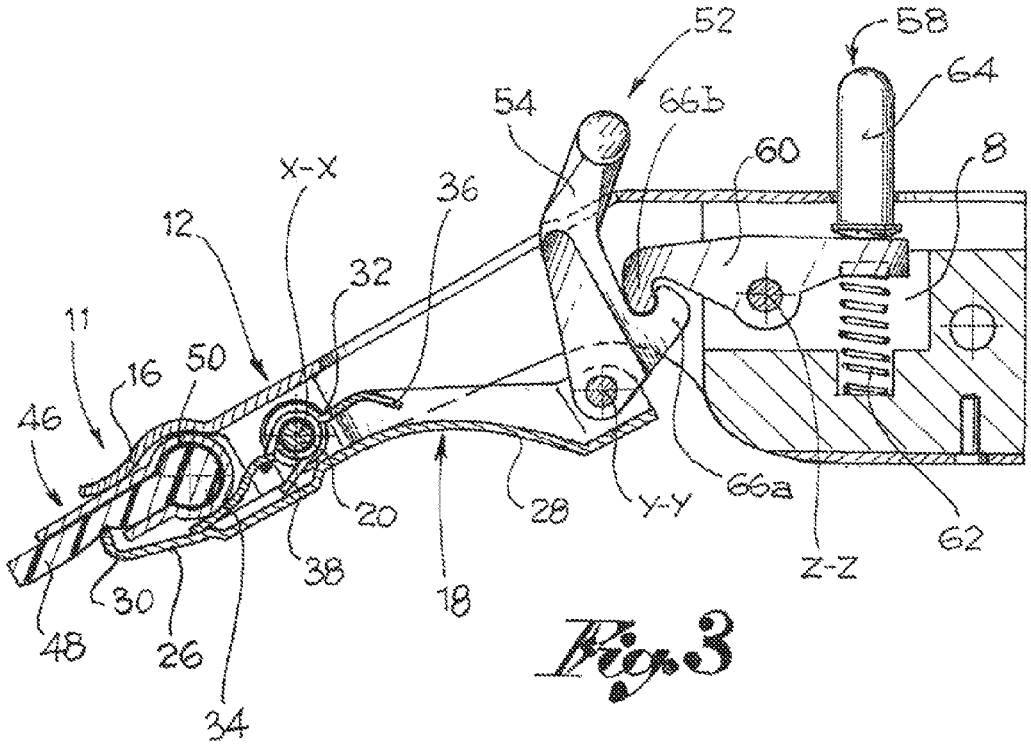
FIG. 3 shows the window squeegee of FIG. 1 in a first condition of normal operation.

In a condition of normal use of the window squeegee 1, spatula 46 is held between said first connection means 12 and said second connection means 18 (FIG. 3).

In other words, in the condition of normal use, lever 54 is in locking position wherein it is engaged with the locking element 60 of the safety means 58.

Locking element 60 is affected by said elastic element 62 so as to remain engaged with said lever 54. Button 64 is in a locking position, for example raised.

Moreover, in a variant of embodiment, shoulders 54*a*, 54*b* of lever 54 abut in the recesses of the first connection element 12, determining a position of the second connection element 18, to which said lever 54 is hinged, adapted for holding the spatula 46.

The second connection element 18, hinged to the rotation axis X-X fixed relative to the first element 12, following the position of lever 54 and therefore of the release axis Y-Y, engages spatula 46 with flap 30, for example gripping the cleaning blade 48.

At the same time, the second connection element 18, in the normal condition of use of the window squeegee, increases the tension of the elastic means 38 that affect the third connection element 32.

In other words, the third element 32, through its thrust portion 34, affects spatula 46, abutting it against the first connection element 12, for example pushing the blade holder 50 against flange 16 of the first connection element 12.

Figure 4:
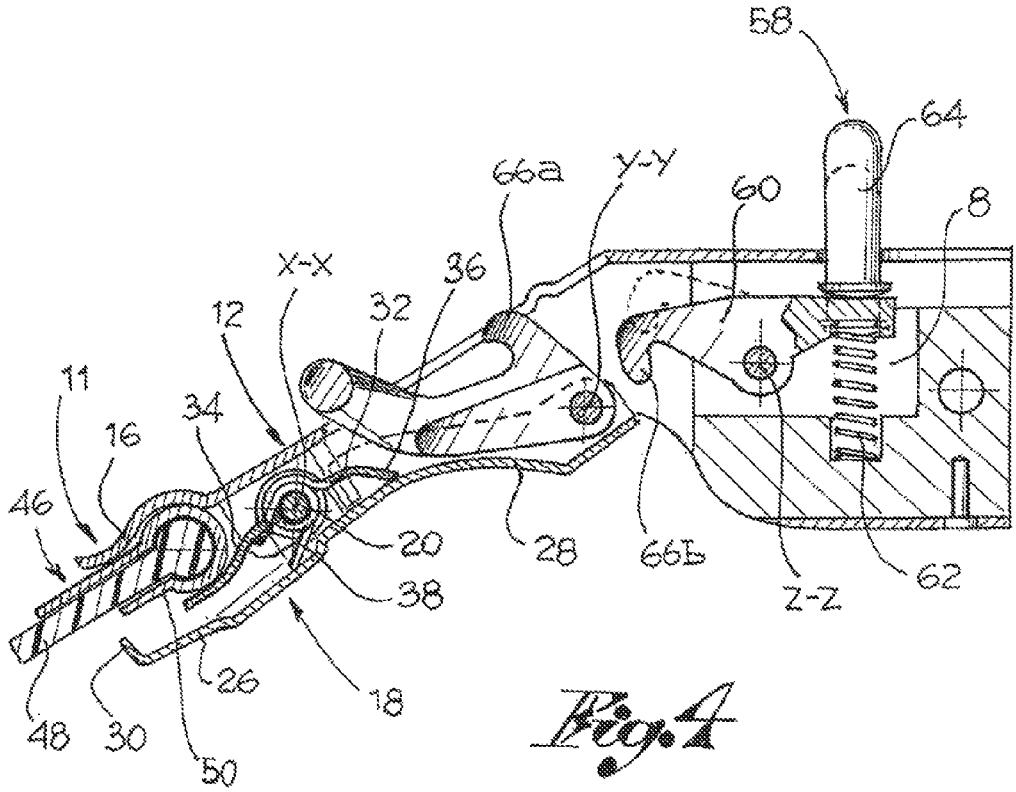
FIG. 4 shows the window squeegee of FIG. 1 in a second condition called of spatula replacement.

Actuating button 64, the locking element 60 disengages from lever 54. Moving lever 54 from the locking position, the second connection element moves away, at least by a portion, from the first connection element 12 (FIG. 4).

Preferably, from the locking condition to the condition of replacement of the spatula, lever 54 disengages from the first element 12 moving the ends of shoulders 54*a*, 54*b* of said lever 54 outside the recesses of the first connection element 12.

Flap 30 of the second element 18, that rotates around the rotation axis X-X following the rotation of lever 54 around the release axis Y-Y and following the disengagement from the first connection element 12, moves away from the first connection element 12.

At the same time, the elastic means 38 are released and the third connection element 32 relieves but does not cancel its influence on spatula 46, to allow its safe and convenient replacement.

In other words, the window squeegee 1 is provided with first safety means that in an embodiment comprise said third element 32, adapted for holding spatula 46 associated to head 11 also during the spatula replacement, allowing at the same time the removal of said spatula from head 11 by the user.

In other words, the window squeegee 1 is provided with first safety means adapted for holding spatula 46 associated to head 11 during the spatula replacement, being provided with a pushing element, such as the third element 32, that in said condition abuts the spatula against the first element 12.

After the replacement, lever 54 is returned to the locking position to hold spatula 46.

The snap mechanism allows—by rotating lever 54 only—the relative sliding of the facing surfaces of the first and second hook element 66*a*, 66*b* up to move the locking element 60 in engagement with lever 54.

Unusually, the squeegee according to the present invention allows replacing the spatula in a safe manner, ensuring at the same time that during normal use, said spatula can be suitably gripped so as to allow cleaning the surface.

Innovatively, the window squeegee according to the invention prevents the removal of the blade holder and its hazardous fall during cleaning operations at a certain height, even while replacing the spatula, that is, when the second element is opened relative to the first one.

Advantageously, in said condition of replacement, the spatula is not removed from the window squeegee head, even though said head is wet with water or water and detergent.

Moreover, advantageously, in the condition of normal use the spatula is held both by a flap of the second connection element that grips the cleaning blade, and by cooperation of the third connection element that abuts the spatula against its flange 16.

According to a further advantageous aspect, the window squeegee according to the invention can house a plurality of spatulas. In other words, the window squeegee according to the invention can house any blade holder regardless of the section profile, thereby allowing the user to use the blades he prefers.

According to a further aspect, such user-preferred blades can be used safely during replacement.

According to a further advantageous aspect, the spatula can be replaced following the actuation of the safety means and afterwards of the locking/release means, said locking/release means being actuated while said safety means remain in the disengaged condition.

According to a further advantageous aspect, the safety means button and the locking/release means lever are arranged in successive positions, suitable for being actuated by a user in a sequence, the lever subsequently the button.

In other words, pressing the button, rotating the lever to the release position and keeping the button in pressed position are convenient operations since the positions of button and lever allow the user to grip the handle and actuate button and lever simply by his thumb.

Finally, the window squeegee according to the invention requires no difficult and repeated maintenance to keep the mechanism that enables the rotation of the second connection element relative to the first one clean, that is free from dirt, mud and the like.

In other words, since there are no mechanisms, for example with screws, the window squeegee according to the invention can be used for a longer time without requiring maintenance.

A man skilled in the art will be able to make changes to the squeegee according to the present invention.

For example, in a variant of embodiment said gripping means comprise a telescopic extension or an arm of a cleaning machine.

In a further variant of embodiment, said safety means are provided with a lever actuable device. In a further variant, they are provided with a ratchet gear.

It is clear that also these variants are to be regarded as falling within the scope of protection as defined in the following claims.

The invention claimed is:

1. A window squeegee for cleaning a surface, said squeegee comprising a head having a first connection element and a second connection element for connecting a spatula to a handle;

said spatula, in a normal, first configuration of the squeegee for removing liquid from said surface, being held between the first connection element and the second connection element;

wherein the second connection element can be at least partly moved away from the first connection element to a second configuration of the squeegee allowing replacement of the spatula; and a third connection element adapted for constantly abutting said spatula against said first connection element or said second connection element, wherein in the second configuration of the squeegee, suitable for replacement of said spatula; a third connection element constantly abuts said spatula against said first connection element or said second connection element.

2. A squeegee according to claim 1, wherein said third element is hinged at a rotation axis (X-X) fixed relative to said first connection element.

3. A squeegee according to claim 2, further comprising an elastic element arranged between said second connection element and said third element to hold the spatula.

4. A squeegee according to claim 1, wherein said second connection element at a free end thereof has a flap adapted for engaging said spatula.

5. A squeegee according to claim 4, wherein said flap grips a cleaning blade of said spatula.

6. A squeegee according to claim 1, wherein said second connection element is hinged to said first connection element at a rotation axis (X-X) to rotate around said axis from the normal use configuration to the second configuration of the spatula.

7. A squeegee according to claim 1, further comprising a locking/release device for locking said spatula for using it.

8. A squeegee according to claim 7, wherein said locking/release device comprises a lever hinged to a release axis (Y-Y) parallel and distinct from a rotation axis (X-X) of said second connection element.

9. A squeegee according to claim 8, wherein said lever comprises shoulders (54*a*, 54*b*) adapted for pushing said second connection element in the normal use configuration.

10. A window squeegee for cleaning a surface, said squeegee being comprising a head provided with a first connection element and a second connection element for connecting a spatula to a handle;

said spatula, in a normal use configuration of the squeegee, being held between the first connection element and the second connection element, said spatula being adapted in said normal use configuration for removing liquid from said surface;

wherein, in a second configuration of said squeegee suitable for replacing the spatula, the second connection element is at least partly moved away from the first connection element to allow the replacement of the spatula, a locking/release mechanism for locking said spatula, wherein said locking/release mechanism comprises a lever hinged to a release axis (Y-Y) parallel and distinct from a rotation axis (X-X) of said second connection element and said lever has shoulders adapted for pushing said second connection element in the normal use configuration, and further comprising a safety mechanism for preventing actuation of said locking/release mechanism.

11. A squeegee according to claim 10, wherein said safety mechanism comprise a locking element hinged on a safety axis (Z-Z).

12. A squeegee according to claim 11, wherein said safety mechanism further comprises a button and an elastic element.

13. A squeegee according to claim 10, wherein said safety mechanism and said locking/release mechanism can be actuated at the same time by a user.

14. A squeegee according to claim 13, wherein said safety mechanism and said locking/release mechanism can be actuated at the same time by a user using just one finger.

15. A squeegee according to claim 14, wherein said safety mechanism comprises a button and said locking/release mechanism comprise a lever.

* * * * *